United States Patent [19]

Rankel

[11] Patent Number: 4,933,067

[45] Date of Patent: Jun. 12, 1990

[54] PIPELINEABLE SYNCRUDE (SYNTHETIC CRUDE) FROM HEAVY OIL

[75] Inventor: Lillian A. Rankel, Princeton, N.J.

[73] Assignee: Mobil Oil Corporation, New York, N.Y.

[21] Appl. No.: 375,063

[22] Filed: Jun. 30, 1989

[30] Foreign Application Priority Data

Nov. 1, 1988 [CA] Canada ..... 581899

[51] Int. Cl.[5] ..... C10C 3/00

[52] U.S. Cl. ..... 208/45; 208/86; 208/95; 208/106

[58] Field of Search ..... 208/86, 95, 96, 106, 208/45, 39

[56] References Cited

U.S. PATENT DOCUMENTS

| | | | |
|---|---|---|---|
| 2,150,119 | 3/1939 | Heisig | 208/106 |
| 2,682,494 | 6/1954 | Weikart | 208/86 X |
| 3,228,870 | 1/1966 | Pitchford | 208/45 |
| 3,472,760 | 10/1969 | Paterson | 208/106 |
| 3,507,777 | 5/1970 | Hemminger | 208/86 |
| 3,511,774 | 5/1970 | Long et al. | 208/86 X |
| 4,334,976 | 6/1982 | Yan | 208/8 |
| 4,522,703 | 6/1985 | Yan | 208/106 |
| 4,604,188 | 8/1986 | Yan et al. | 208/106 |

*Primary Examiner*—Glenn Caldarola

*Attorney, Agent, or Firm*—A. J. McKillop; C. J. Speciale; R. D. Stone

[57] ABSTRACT

A process is provided for preparing pipelineable syncrude and asphalt from a heavy crude oil. The syncrude has substantially less metals content and Conradson Carbon Residue than the precursor crude oil, and may be used as feed for catalytic cracking or as fuel oil. The asphalt is adaptable for paving. The process consists of air-blowing the crude, deasphalting the air-blown product, and thermally cracking the deasphalted oil to reduce its viscosity, in that order.

The process is adaptable to on-site use in or near a heavy oil field, using skid-mounted equipment.

10 Claims, No Drawings

PIPELINEABLE SYNCRUDE (SYNTHETIC CRUDE) FROM HEAVY OIL

FIELD OF THE INVENTION

This invention is concerned with upgrading heavy crude oil. It is particularly concerned with manufacturing a pipelineable syncrude and an upgraded asphalt from heavy crude oil.

BACKGROUND OF THE INVENTION

Extensive reserves of petroleum in the form of so-called "heavy crudes" exist in a number of countries, including Western Canada, Venezuela, Russia, the United States and elsewhere. Many of these reserves are located in relatively inaccessible geographic regions. The United Nations Institute For Training And Research (UNITAR) has defined heavy crudes as those having an API gravity of less than 20, suggesting a high content of polynuclear compounds and a relatively low hydrogen content. The term "heavy crude", whenever used in this specification, means a crude having an API gravity of less than 20. In addition to a high specific gravity, heavy crudes in general have other properties in common, including a high content of metals, nitrogen, sulfur and oxygen, and a high Conradson Carbon Residue (CCR). The heavy crudes generally are not fluid at ambient temperatures and do not meet local specifications for pipelineability. It has been proposed that such crudes resulted from microbial action which consumed alkanes, leaving behind the heavier, more complex structures which are now present.

A typical heavy crude oil is that recovered from the tar sands deposits in the Cold Lake region of Alberta in northwestern Canada. The composition and boiling range properties of a Cold Lake crude (as given by V. N. Venketesan and W. R. Shu, J. Canad. Petr. Tech., page 66, July-August 1986) is shown in Table A. A topped Mexican heavy crude is included for comparison. The similarities are evident.

TABLE A

Analysis of Maya 650° F. and Cold Lake Oil

| | Maya 650° F.+ | | Cold Lake (Lower Grand Rapids Primary Production) |
|---|---|---|---|
| % C | 84.0 | | 83.8 |
| H | 10.4 | | 10.3 |
| N | 0.06 | | 0.44 |
| O | 0.97 | | 0.81 |
| S | 4.7 | | 4.65 |
| CCR | 17.3 | | 12.3 |
| % $C_7$-Insoluble Asphaltenes | 18.5 | | 15.0 |
| Ni, ppm | 78 | | 74 |
| V, ppm | 372 | | 175 |
| Boiling Range | | | |
| 75-400° F. | 0.62 | 75-400° F. | 1.3 |
| 400-800° F. | 21.7 | 400-650° F. | 15.2 |
| 800-1050° F. | 19.0 | 650-1000° F. | 29.7 |
| 1050° F.+ | 58.71 | 1000° F.+ | 53.8 |

Cold Lake crude does not meet local (Canadian) pipeline specifications. A sample, believed typical, had the temperature-flow behavior shown in Table B.

TABLE B

| Temperature | Viscosity, cs (centistokes) |
|---|---|
| 2° C. (28° F.) | Solid |

TABLE B-continued

| Temperature | Viscosity, cs (centistokes) |
|---|---|
| 38° C. (100° F.) | 4797 |
| 54° C. (130° F.) | 1137 |
| 100° C. (212° F.) | 82 |

The heavy crudes play little or no role in present-day petroleum refineries. Two principal reasons for this are that they are not amenable to ordinary pipeline transportation, and that because of the high metals and CCR values, they are not readily converted to a high yield of gasoline and/or distillate fuels with conventional processing. The progressive depletion and rising cost of high quality crudes, however, create a need for new technology which would inexpensively convert heavy crudes to pipelineable syncrudes, preferably with concomitant upgrading of quality, i.e. ease of conversion to the gasoline and/or distillate fuels which are in heavy demand. Such technology would augment the supply of available crude, and would make it possible for refiners to blend such syncrude with a more conventional feed for catalytic cracking and hydrocracking.

A number of methods have been proposed for decreasing the viscosity of a heavy crude oil so as to improve its pumpability. These include diluting with a light hydrocarbon stream, transporting by heated pipeline, and using various on-site processing options including visbreaking, coking and deasphalting. With most heavy crudes, conventional visbreaking or conventional deasphalting alone cannot give sufficient viscosity reduction. Attempts to reduce the viscosity to the required level by these routes usually lead to an incompatible two-phase product from visbreaking and to a very low yield of deasphalted syncrude from deasphalting. Promising alternatives for on-site production of pipelineable syncrude by combination of a thermal step and deasphalting are being proposed. Such combinations are described, e.g. in copending application Ser. No. 375,070, Ser. No. 375,066, and Ser. No. 375,068, filed on even date herewith.

Another problem usually associated with development of heavy crude oil production is the provision of roads essential to provide mobility for personnel in the oil field itself and between the oil field and adjacent housing and other support facilities. Because heavy oil fields often are located in remote areas, materials for road construction would have to be transported at high cost. Paving asphalt derived from the heavy crude oil would provide an ideal and abundant low-cost material for such road construction.

It is known that "thermal asphalts", i.e. asphalts obtained from crude oils after subjecting the oil to a temperature of 750° F. or higher, as in visbreaking, produces a degraded asphalt product that is not suitable for roads.

DESCRIPTION OF THE INVENTION

This invention provides a process for converting a heavy crude oil to a pipelineable, substantially upgraded syncrude and a blown asphalt suitable for road building. The process consists essentially of air blowing at least the 650° F.+ fraction of the heavy crude oil; solvent deasphalting the blown oil to recover good quality asphalt and an intermediate syncrude having much lower metals and Conradson Carbon Residue (CCR) than the precursor crude oil; and visbreaking the intermediate syncrude to impart to it pipelineable flow properties, all as more fully described hereinbelow.

The invention may be conveniently practiced in any suitable oxidizer reactor capable of operating within the following parameters: a temperature of about 390° to about 660° F. preferably 440° to 620° F.; a pressure of about 100 to about 300 psig air, preferably 150–300 psig; and 500 to 4000 scf/bbl air flow. Suitable reactors include vessels or towers with packing to facilitate gas-liquid contact. Trickle bed operation is preferred. Treatment time will depend on temperature and other parameters, but in any case is long enough to incorporate at least about 0.5 wt % oxygen combined with the oil. The high content of nickel and vanadium in the heavy oil serves as oxidation catalyst. Should additional catalytic effect be desired, vanadium in the form of $V_2O_5$ on alumina, or a high vanadium content petroleum coke may be included with the tower packing.

After oxidation the heavy crude oil has acquired from about 0.5 to about 3 weight percent oxygen and then is ready for the second step of the combination process, the deasphalting step. This is an important carbon rejection step, which not only reduces substantially the Conradson Carbon Residue, but also very substantially reduces the content of metal and sulfur in the final syncrude product.

For purposes of the present invention, any paraffinic or other solvent useful for conventional deasphalting may be used. And, the solvent to oil ratio may be any conventional solvent to oil ratio useful with the chosen solvent. It is a feature of this invention that highly satisfactory deasphalting results are achieved even with naphthas, i.e. mixtures of hydrocarbon solvents. In one aspect of this invention, it is contemplated, and indeed particularly preferred, to use as deasphalting solvent naphthas boiling within the range of 30° F. to 200° F. that can be recovered from the thermal conversion step. With this modification, no extrinsic source of naphtha is required. Suitable napthas may also be obtained from natural gas condensate. Solvent to oil ratios need not be extreme at either end, i.e. about 3:1 up to 10:1 may be used, thus minimizing the processing and capital investment costs for this stage of the process. And finally, after conventional separation of the oil phase from the asphalt phase, it is not essential for purposes of this invention to completely remove the solvent from the oil phase. It is contemplated that a small amount of residual solvent, such as 1 percent up to 10 percent, may be advantageously included in the pipelined oil. Depending on the method of using the final asphalt, a similar amount of residual solvent may be advantageous.

In a particularly preferred embodiment of this invention, it is preferred to recover at least the bulk of the solvent from the oil phase by supercritical separation.

Supercritical separation entails raising the oil and solvent mixture stream from the deasphalter to a temperature and pressure above the psuedocritical temperature and pressure of the solvent employed. At these conditions the oil and solvent separate into a liquid oil phase and a supercritical solvent phase. These phases can be drawn off the separator in a manner similar to a liquid/liquid separator. By separating the solvent in this manner it is possible to attain the desired separation without supplying the heat of vaporization required in evaporative separation of the solvent. The net result is a considerable saving in process heat.

The thermal step used in this invention is similar to the conventional visbreaking processes which have been used for years in petroleum refineries to reduce the amount of cutter stock needed to produce heavy fuel oil meeting viscosity specifications from residual oils. The process and apparatus need not be described here in detail since it is well known. Conventional visbreaking is conducted at final outlet temperatures of 800° F. to 925° F. and a total reaction time of only a few minutes. At high reaction severity, which is attained at longer times and higher temperatures, secondary reactions of condensation and polymerization become important. These reactions normally are undesirable since they lead to the production of coke and residual products which are not fully compatible with conventional cutter stocks. As a result, there is a maximum severity at which visbreakers can be run. This maximum severity is known to be charge stock dependent.

Visbreaking, like thermal cracking, is kinetically a first-order reaction. The severity of visbreaking is often expressed as ERT (equivalent residence time at 800° F. in seconds), calculated by multiplying the cold oil residence time above 800° F. by the ratio of relative reaction velocities as defined by Nelson (W. L. Nelson, Petroleum Refinery Engineering, 4th Ed., FIG. 19–18, page 675) taking into consideration the temperature profile across the visbreaker coil, using the average temperature for each one foot segment of the coil above 800° F. The maximum visbreaking severity varies for different crudes, but typically it is below about 700 ERT seconds. All references made herein to severity in terms of ERT or ERT seconds are intended to mean the equivalent severity at 800° F. in seconds, regardless of the actual temperature or temperatures used, calculated as described above or by a mathematically equivalent method.

In the present invention, the heavy oil is thermally treated at 800° to 950° F. and for a time to produce a severity of at least 400 ERT to about 3000 ERT seconds, preferably 750–2500 ERT seconds. While such severity would normally not be tolerable in conventional visbreaking, in the present invention the thermal treatment is conducted with an oil which is substantially free of asphaltenes and other sediment-forming constituents so that incompatible sediment is not formed as readily as in conventional visbreaking.

While the broad permissible severity range is 700 ERT to 3000 ERT sec., as given above, there may be instances for specific crude for which the higher severities in the range result in substantial amounts of highly dispersed coke being formed, i.e. more than about 2 wt % coke. Because this coke may interfere with continuous processing, it is much preferred to operate at a severity at least about 700 ERT sec. but less than that at which more than 2 wt % coke forms. Within such range, increased severity produces a lower viscosity product and a larger amount of material boiling within the naphtha range without excessive coke formation. The term "coke", as used herein, means material that is insoluble in hot toluene.

Operating pressure for the thermal step of this invention is critical only insomuch as it determines the degree of vaporization and hence the specific volume of the products and reactants in the reactor. In a continuous unit this specific volume determines the velocity and residence time of the reactants and products. It is contemplated that reactor exit pressure would be between about 30 and 500 psig. Inlet pressure would be that required to attain the desired velocity and residence time of the feed in the conversion apparatus.

For purposes of this invention, thermal treatment may be conducted by passing oil through a simple conventional coil in which the coil is heated in a furnace, as is done in visbreaking. Alternatively, the design which employs a coil and a soaker drum may be used. The soaker drum variant is preferred for purposes of the present invention. The term "reactor" as used herein means either the coil alone where such is used, or the coil plus soaker drum otherwise. The "reactor outlet" in the latter case of course means the soaker drum outlet.

It is contemplated that any heavy crude may be used as feed to the process of this invention. Optionally, if desired, the heavy crude may be topped to remove materials boiling below 650° F. before the air-blowing step.

The particular sequence of steps described herein is an essential feature of this invention. Because the recovered air blown asphalt and oil precursor have never been exposed to high temperature, the quality of the asphalt is not degraded; in fact, it is harder and more ductile than that obtained from the crude oil itself. And because the thermal treatment is conducted on an oil substantially free of asphalt, a higher severity is tolerated with greater viscosity reduction than would otherwise be the case.

EXAMPLES

The following examples are given to illustrate certain aspects of this invention. These examples are not to be construed as limiting the scope of the invention, which scope is determined by this entire specification and appended claims.

EXAMPLE 1

An untreated Arab Light vacuum resid was deasphalted with pentane to yield about 15 wt % asphaltenes. The pentane-insoluble asphaltenes powder was placed on aluminum foil (1½ inch square of powder) and heated slowly under nitrogen until melted to form a coating of about one-sixteenth inch thickness. On cooling, the coating cracked and was brittle. This example serves as control.

EXAMPLE 2

A sample of the same Arab Light vacuum resid as used in Example 1 was air-blown and then deasphalted with pentane to yield 25 wt % asphaltenes. The asphaltenes powder was placed on aluminum foil and heated in the same manner as was done in Example 1. In this case a hard, glossy crack-free coating formed on cooling. The cooled coating tolerated some bending before cracking, indicating improved ductility. This example illustrates the improvement in yield and quality of the asphaltic fraction recoverable from an air-blown crude, using the vacuum resid of Arab Light as a model for a heavy crude oil.

What is claimed is:

1. A process for converting a metals-contaminated heavy crude oil characterized by an API gravity less than about 20° and a substantial Conradson Carbon Residue to a pipelineable and substantially upgraded syncrude with concomitant recovery of blown asphalt, said process comprising:

(a) air-blowing at least the 650° F.+ fraction of the heavy crude oil at a temperature of 390° to 660° F. under conditions effective to increase its combined oxygen content by at least 0.5 weight percent;

(b) deasphalting said air-blown crude oil with solvent whereby separately recovering a blown asphalt and an intermediate syncrude having a substantially lower concentration of metals and less Conradson Carbon residue than said heavy crude oil; and, (c) visbreaking said intermediate syncrude at 800° to 950° F. and at a severity effective to impart to it pipelineable viscosity characteristics.

2. The process described in claim 1 wherein said severity is at least 400 to 3000 ERT seconds.

3. The process described in claim 2 wherein said severity is at least 700 ERT seconds but not exceeding that at which more than 2 weight percent coke is formed.

4. The process described in claim 1 wherein the solvent for said deasphalting step is a paraffinic naphtha boiling within the range of 30° to 200° F.

5. The process described in claim 4 wherein said solvent for said visbreaking step or from natural gas condensate.

6. The process described in claim 1 wherein solvent recovery from the oil phase in the deasphalting step is by supercritical separation.

7. The process described in claim 2 wherein solvent recovery from the oil phase in the deasphalting step is by supercritical separation.

8. The process described in claim 3 wherein solvent recovery from the oil phase in the deasphalting step is by supercritical separation.

9. The process described in claim 4 wherein solvent recovery from the oil phase in the deasphalting step is by supercritical separation.

10. The process described in claim 5 wherein solvent recovery from the oil phase in the deasphalting step is by supercritical separation.

* * * * *